US007827720B1

(12) United States Patent
Erdem

(10) Patent No.: US 7,827,720 B1
(45) Date of Patent: Nov. 9, 2010

(54) AUTOLOADING HANDGUN

(76) Inventor: Saim Alper Erdem, Gelik Sokak No. 22, Ferahevler/Tarabya, Istanbul (TR)

( * ) Notice: Subject to any disclaimer, the term of this patent is extended or adjusted under 35 U.S.C. 154(b) by 210 days.

(21) Appl. No.: 12/219,762

(22) Filed: Jul. 28, 2008

(51) Int. Cl.
*F41A 17/42* (2006.01)
*F41A 17/64* (2006.01)

(52) U.S. Cl. ..... 42/70.08; 42/70.01

(58) Field of Classification Search ..... 89/196; 42/69.02, 70.01, 70.04, 70.05, 70.06, 70.08
See application file for complete search history.

(56) References Cited

U.S. PATENT DOCUMENTS 1,563,675 A * 12/1925 Tansley ..... 89/128
1,664,788 A 4/1928 Oberhammer
2,921,503 A 1/1960 Browning
3,207,037 A 9/1965 Pachmayr et al.
4,003,293 A 1/1977 Uria et al.
4,414,769 A * 11/1983 Mueschke ..... 42/70.01
4,539,889 A 9/1985 Glock
4,590,697 A * 5/1986 Ruger et al. ..... 42/70.08
4,972,760 A * 11/1990 McDonnell ..... 89/196
5,069,110 A 12/1991 Menck
5,076,139 A * 12/1991 Hiett ..... 89/198
5,347,912 A 9/1994 Gathoye
5,386,659 A * 2/1995 Vaid et al. ..... 42/69.02
5,655,326 A 8/1997 Levavi et al.
5,903,994 A 5/1999 Tange
5,913,666 A * 6/1999 Perkins ..... 42/70.11
6,257,116 B1 7/2001 Moczijdlower et al.
6,601,331 B2 * 8/2003 Salvitti ..... 42/70.08
6,622,609 B1 9/2003 Barkan
6,941,692 B1 * 9/2005 Krinke et al. ..... 42/70.08
7,121,035 B2 10/2006 Greer
7,140,141 B2 * 11/2006 Vaid ..... 42/108
7,194,833 B1 * 3/2007 Curry ..... 42/14
7,353,630 B2 * 4/2008 McGarry ..... 42/16
2001/0022131 A1 9/2001 Moczijdlower et al.
2001/0037596 A1 * 11/2001 Salvitti ..... 42/70.08
2002/0104248 A1 * 8/2002 Szabo ..... 42/70.01
2003/0089016 A1 * 5/2003 Hyytinen ..... 42/70.11
2003/0145504 A1 * 8/2003 Durossette ..... 42/70.04
2006/0064914 A1 3/2006 Greer
2006/0248772 A1 * 11/2006 Curry ..... 42/69.02
2007/0180752 A1 * 8/2007 Houde-Walter ..... 42/114

* cited by examiner

*Primary Examiner*—Bret Hayes
(74) *Attorney, Agent, or Firm*—Richard C. Litman

(57) ABSTRACT

The autoloading handgun is a short recoil, locked breech, semiautomatic service pistol. A rear located safety latch is provided for ambidextrous usage. A hold-open lever opens the pistol after the last round in the magazine is fired. A recoil spring guide rod, which alone is used for field stripping, is provided. Only three moving elements, a trigger, trigger bar, and a striker are required for firing. The hold-open lever is formed from a single piece lever acting laterally and cooperating with the magazine follower. A standard Browning swinging barrel lock is utilized wherein at the instant of firing, barrel and breechblock remain locked with each other, recoil backward for a small distance, and then swing vertically away from each other via cam elements. The swinging barrel lock construction has no intermediate parts.

6 Claims, 16 Drawing Sheets

AUTOLOADING HANDGUN

BACKGROUND OF THE INVENTION

1. Field of the Invention

The present invention relates to firearms, and more particularly to an autoloading handgun.

2. Description of the Related Art

The design of semiautomatic pistols has not changed significantly since the introduction of the Colt .45 Model 1911 in the early 1900s. Since that time, others have made some minor modifications in the basic design, but nothing of a fundamental nature.

For example, in the Model 1911 pistol, cartridges are stored in an ammunition clip, which is inserted into the grip of the pistol. Cocking and firing of the gun are accompanied by movement of an external slide, and spent shells are ejected from the top of the gun, where they can be distracting to the shooter. The slide travels a distance on the order of two inches each time the gun is fired, and this limits the cycle time or rate at which successive rounds can be fired. Problems encountered using the aforementioned design include the method of joining (attaching) the main components and removing them for maintenance and repair purposes, and the construction of moving parts for firing the weapon. Moreover, the location of the safety latch and its construction remains problematic in that it does not serve well the ambidextrous user. Additionally, the device to hold open the pistol after firing of the last round in the magazine could be improved in its design.

These components and other parts of the action are subject to substantial wear leading to mechanical failure. There exists a long felt need for substantial improvement with respect to design of the aforementioned handgun components.

Thus, an autoloading handgun solving the aforementioned problems is desired.

SUMMARY OF THE INVENTION

The autoloading handgun is a short recoil, locked breech, semiautomatic service pistol. A rear located safety latch is provided for ambidextrous usage. A hold-open lever holds the slide of the pistol open after the last round in the magazine is fired. A recoil spring guide rod, which alone is used for field stripping, is provided. Only three moving elements, a trigger, a trigger bar, and a striker are required for firing, thereby eliminating the necessity of a sear and a disconnector.

The hold-open lever is formed from a single piece lever acting laterally and in operable communication with the magazine follower. A standard Browning swinging barrel lock is utilized, wherein at the instant of firing, the barrel and the breechblock remain locked with each other, recoil backward for a small distance, and then swing vertically away from each other due to the action of cam elements. The swinging barrel lock construction has no intermediate parts.

These and other features of the present invention will become readily apparent upon further review of the following specification and drawings.

BRIEF DESCRIPTION OF THE DRAWINGS

All figures of the autoloading handgun are shown without a magazine inserted. Similar reference characters denote corresponding features consistently throughout the attached drawings.

DETAILED DESCRIPTION OF THE PREFERRED EMBODIMENT

Figure 1:
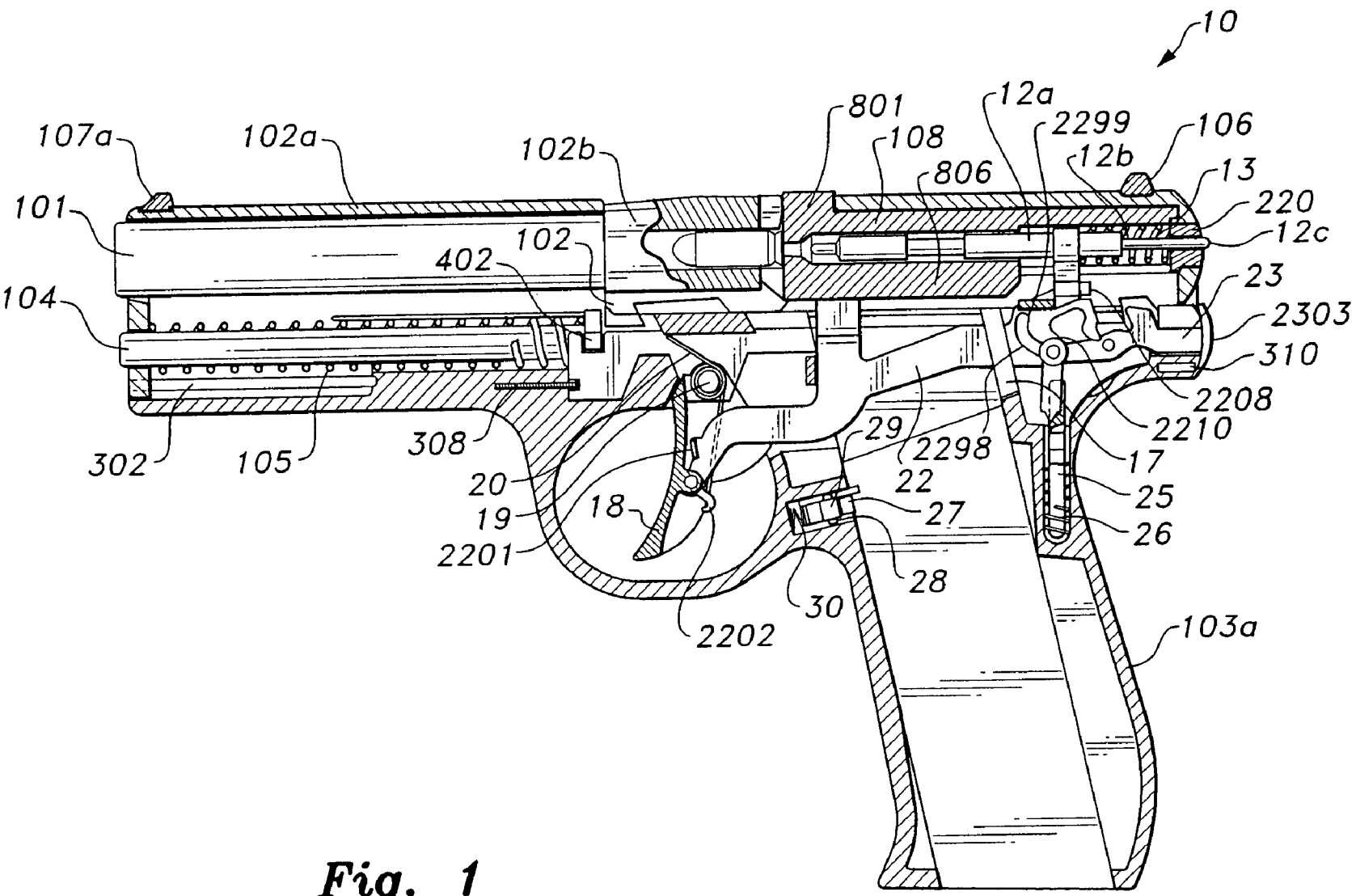
FIG. 1 is a side view of the autoloading handgun according to the present invention, broken away and partially in section.

As shown in FIG. 1, the autoloading handgun is a short recoil, locked breech, semiautomatic service pistol 10. The pistol 10 features few moving parts, including components that allow for ease of field stripping, a rear located safety latch, and an internally disposed elongate hold-open lever 15 that pivots to hold open the slide 102*a* of pistol 10 responsive to a position of a magazine follower after the last round in the magazine is fired. A recoil spring guide rod 104, which alone is used for field stripping, is provided.

Moreover, the autoloading handgun 10 can be configured to require only three moving elements, a trigger 18, trigger bar 22, and a striker 12*a* for firing. Intermediary parts such as a sear and a disconnector, may be manufactured with other features of the handgun 10, but are not required. A safety latch 23 suitable for ambidextrous use is located at the rear of the receiver below the end of the reciprocating slide. The hold-open lever is formed from a unitarily constructed pivoting elongate member 15 acting laterally and in operable communication with the magazine follower. The pistol 10 uses a standard Browning swinging barrel lock wherein at the instant of firing, barrel and breechblock remain locked with each other, recoil backward for a small distance, and then swing vertically away from each other via cam elements in relation to opposing blocks. The swinging barrel lock construction has no intermediate parts, and other features contribute to a design of greater safety, minimal complexity, and ease of disassembly and reassembly. During firing of the weapon 10, there is certain gas leakage through bullet and bore of barrel 101 to the forward, thus recoiling begins before the projectile leaves the barrel. However, backward travel of barrel 101 is so calculated that an adequate bullet-slide and barrel weight ratio permit the projectile to leave bore 207 of the barrel 101 before swinging down unlocking action of the barrel 101. Approximately 3 mm linear backward travel is acceptable for all standard service cartridges via roughly 1/33 of stated barrel weight ratio in relation to the projectile (bullet).

Figure 2:
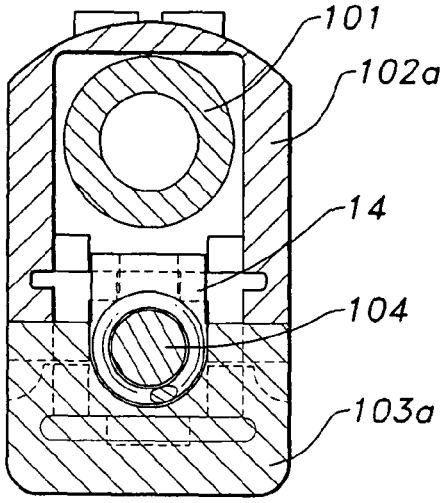
FIG. 2 is a section view of the autoloading handgun according to the present invention, showing the barrel, slide and receiver.
Figure 3:
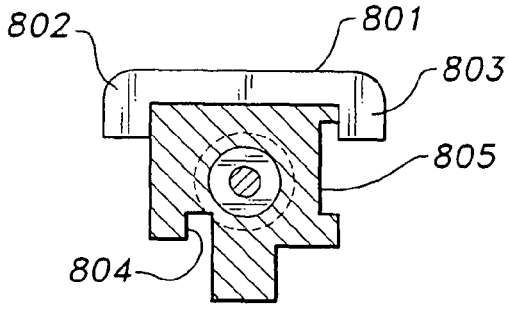
FIG. 3 is a section view of the breechblock of the autoloading handgun according to the present invention.
Figure 20:
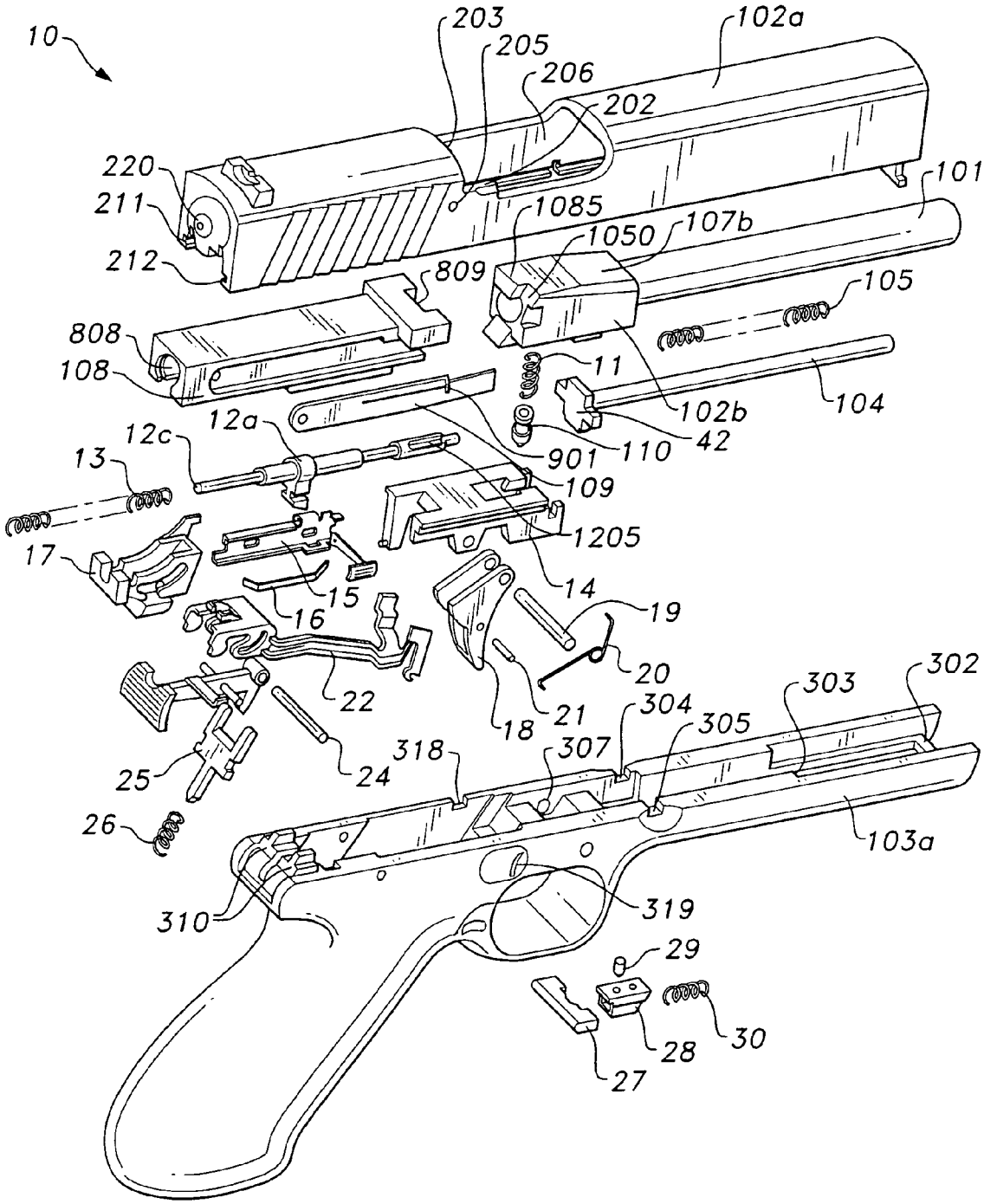
FIG. 20 is an exploded, perspective view of the autoloading handgun according to the present invention.

As shown in FIGS. 1, 2 and 20, the pistol 10 is comprised of a barrel 101, slide 102*a*, and receiver 103*a*. The barrel is located in front section of the slide 102*a* that embraces its all top and sides and has a rifled tube 101 attached to the breech 102*b* creating the cartridge chamber within. First and second lower lugs 992, 993 (shown in FIG. 6) are disposed under the breech section to provide cam motion. A rear lug 1805 (shown in FIG. 7) is provided at rear of top 107*b* for retaining correct headspace. Rear lug 1805 has a tapered vertical cut which is provided thereon to ensure that the chamber being loaded and the top front step 107*b* of the breech is used as a locking shoulder as to abut precisely against the front end of top window 206 of slide 102*a* for lock up. The barrel 101 can be made of unitary construction or the tube section pinned within the lug carrier portion.

The slide 102*a* is formed from precise 'U' profiles with both ends being welded thereon to reduce the cost of manufacturing. Rear and front sights 106, 107*a* are dovetailed in provided grooves at top ends of the slide 102*a*. Rear portion of slide 102*a* has serrations for sure gripping.

The breechblock 108 closing the rear of breech 102*b* is located at rear of the slide and has lugs in front of its top 801 extending downwardly at sides 802,803 sitting over the flat supports 202, 203 provided at rear section of the top window 206. As shown in FIGS. 1-3 and 20, there is a circular recess 804 at rear of the breechblock 108 that the cylindrical back guide 220 of slide precisely to fit therein as combination of lugs 801, 802, 803 to arrest the location of breechblock 108 in the slide 102*a* and the breechblock 108 is retained on the aforementioned position by locking effect of a small pin 901 unitarily constructed from a front extended top portion of leaf extractor 109, the leaf extractor 109 being mounted in a longitudinal recess 805 cut out at right side of the breechblock 108 as retaining its own place by a pin fitting into a hole provided at rear of recess 805.

Figure 8:
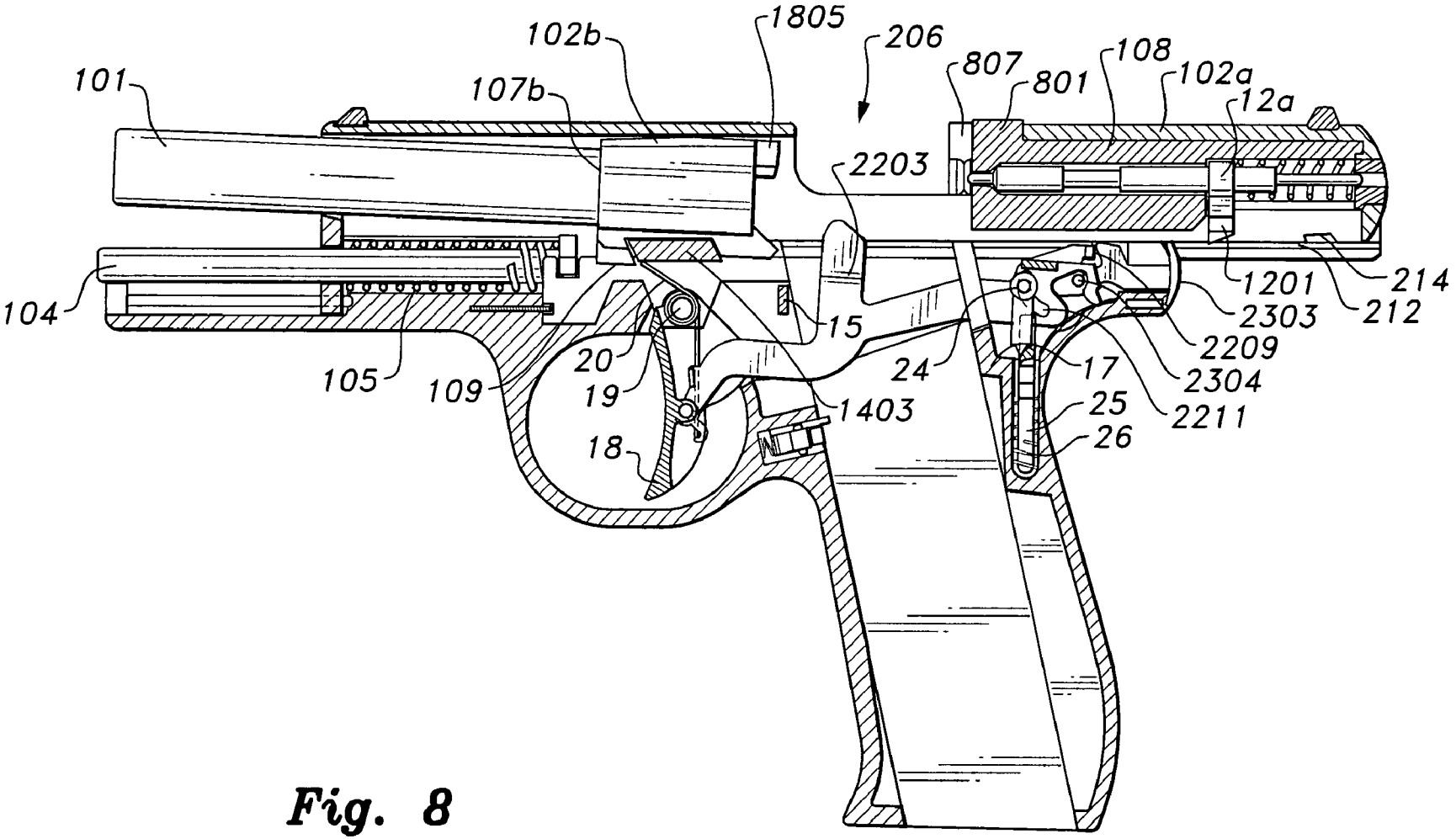
FIG. 8 is a side view of the autoloading handgun according to the present invention, broken away and partially in section, showing elevation of the barrel via cam action.

The lock pin 901 slightly protrudes its tip through a small hole 205 to right outside for manual unlocking. The slide 102*a* is cut out on the top beginning from the rear of breechblock lugs 801, 802, 803 and extending forward all along the top of the breech forming the top window 206 as going downward at the sides being lower at the right to shape the ejection hole and the front end of top window 206 is used for the locking shoulder of slide against to the breech and the rear section of top window turns to the support flanges for breechblock guide lugs. As shown in FIGS. 1, 8 and 20, there is a longitudinal underlug 806 at front half of the breechblock to facilitate cartridge push out from the magazine and the front of underlug 806 joins at underside of a vertical channel 807 cut in front of the breechblock to receive the bottom of cartridge case and back lug 1050 of breech on rest and tilted down positions. Lug 1060 is disposed in a complementary position to back lug 1050.

Figure 10:
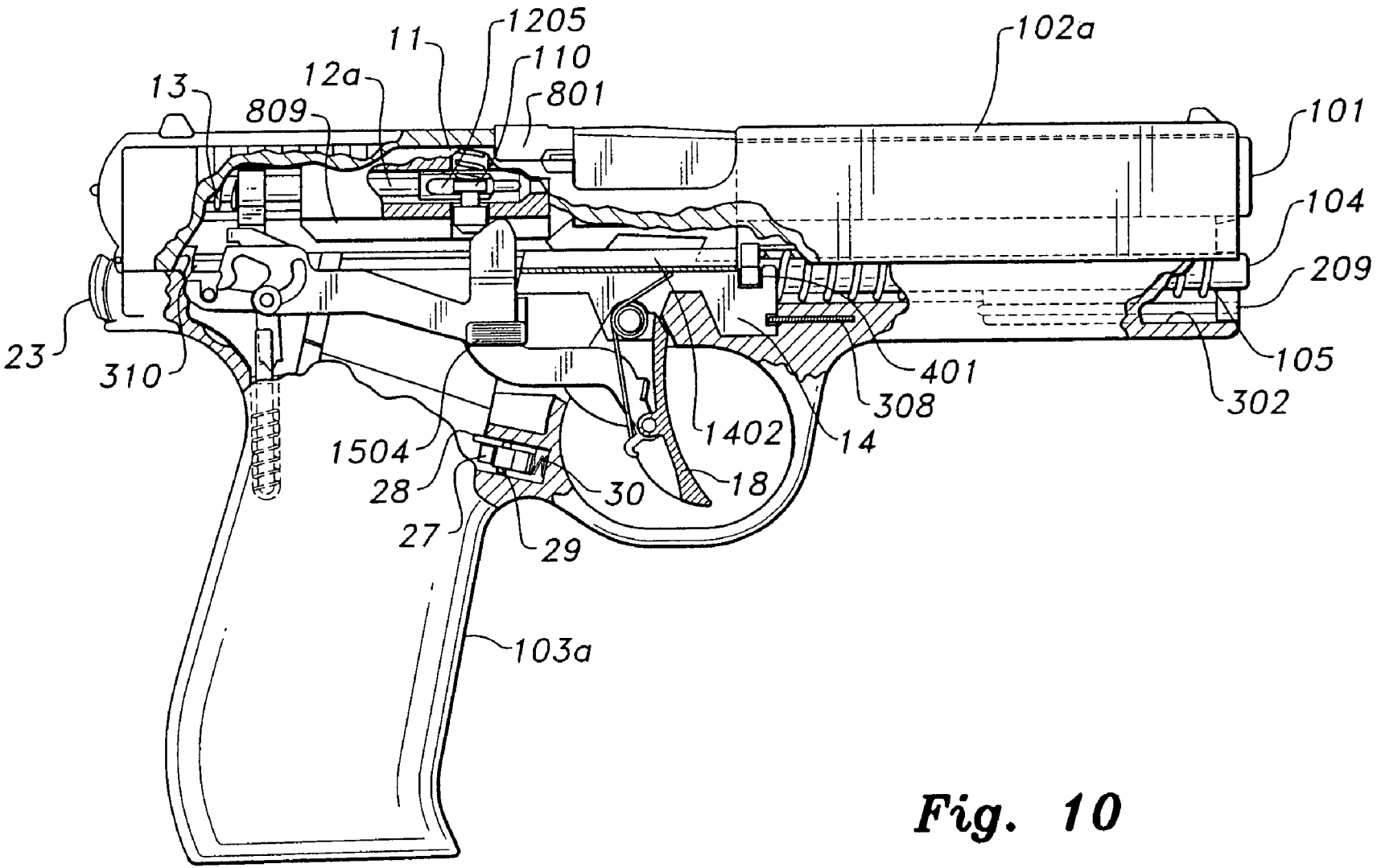
FIG. 10 is a right side view of the autoloading handgun according to the present invention, broken away and partially in section, illustrating the relationship between the trigger bar and the safety lever.
Figure 11:
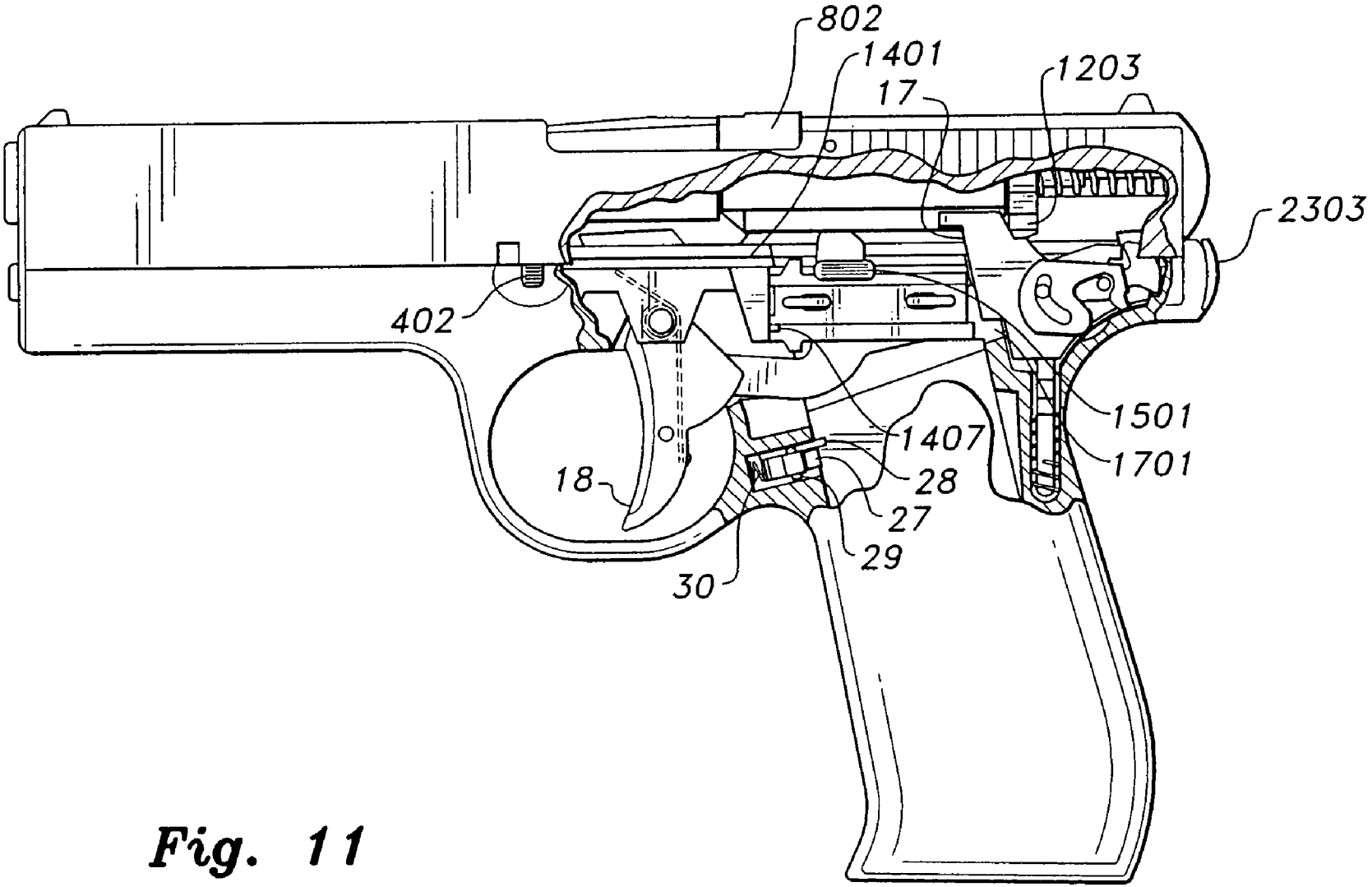
FIG. 11 is a left side view of the autoloading handgun according to the present invention, broken away and partially in section, showing the fingerpiece of the hold-open lever.

There is a longitudinal tubular channel 808 opening into channel 807 with a reduced hole for striker 12*a* and its front detonator tip to strike over the cartridge cap therethrough and a rear end of tubular channel 808 joins with circular recess 804 for back guide 220. The extractor 109 formed from a leaf spring also extends its hooked tip into vertical channel through a short groove at right to grip the cartridge case back over its extractor groove and the ejector passage 809 also open to left under of vertical channel as being cut full alongside the striker channel and being joining with bottom underlug 806 at bottom side in its front half. The breechblock has another tubular recess vertically crossing the striker channel through its right near the front for striker safety 110 and spring 11 disposed over the striker safety 110 (shown in FIG. 10). Complete breechblock can be machined from stock or made by investment casting.

The front end of slide 102*a* has two superposed holes of different sizes as the larger on top for barrel cross out and the smaller disposed below for recoil spring rod cross out and both being beveled at underside to the rear to facilitate an angled mounting and dismounting procedure. There are small sidewardly disposed lugs at both side of slide front end to fit into guiding grooves 302 provided at counter-locating sections of receiver front.

The firing element of pistol 10 is striker I2*a* carrying its own actuator spring 13 being coiled around at the rear portion 12*b* for working on line with barrel axis and the rear tip 12*c* thereof protruding slightly rearward to outside through a hole drilled in the back guide 220 when in cocked position and normally rests at the beginning of the hole for precise guiding of the reciprocal movement of striker 12*a*.

The rear coil of striker spring 13 rests against the front face of back guide 220 and this guide is press fitted into the back end of slide 102*a*. The back end of slide 102*a* has appropriate cuts at bottom for ejector and trigger bar components to cross through and the bottom line thereat is beveled in and out for trigger bar flanges 2208 to ride over during the dismounting. The striker 12*a* has a bottom leg 1201 that extends downward from a mid portion of the striker, the bottom leg 1201 ending with an inverted bevel the front face of which acts as a cocking shoulder that abuts the trigger bar 22. Striker bottom leg 1201 has small longitudinal grooves 1202, 1203 at either side just above a far end of the leg to facilitate trigger bar flanges 2208, 2209 passing therethrough to go to a cocked position. Striker 12*a* has another longitudinal groove 1205 in a front right side portion thereof for placement of striker safety 110 in a cocked mode.

The breechblock 108 is removably mounted in rear section of the slide 102*a* as aligned with the back guide 220 with the lugs 802,803 sitting over the flanges 202,203 at rear of the top window 206 and pushed rearward until the lock pin 901 fits into lock pin receiving hole 205 at right rear of the top window with a click. Removing the breechblock from its location is an infrequent process unlike field stripping and is done if any repair or detailed cleaning needs and it begins with a powerful pin push onto the lock pin 901 against its powerful leaf spring and ends by pulling the breechblock forward and upward through the top window 206.

As shown in FIGS. 10, 11, 20 and 22, the slide 102*a* has small upright recesses at bottom of its side walls as being symmetrically cut near to middle as can be seen at outside for risen lugs 401, 402 of recoil spring guide back plate 42 during dismounting process and two other ones behind them that can not be seen outside as being near to front of breech block inside 215 for hold-open lever 15 at left and being near to rear 214 for safety latch at right to block the slide motion when the safety "on" and there are longitudinal grooves 211, 212 at inner side of side walls near the bottom for guiding rails 310 at back of the receiver 103*a* and for guiding rails 1401, 1402 cut at sides of barrel seat 14 for reciprocal movement of slide 102*a* over the receiver 103*a*. The receiver 103*a* is formed by mold injection of glass reinforced polymer for saving weight and manufacturing costs and carries a standard double row magazine in a well 301 that outside of which forms the handle section of handgun 10.

Longitudinal grooves 302, 303 are disposed on lateral sides of a front portion of the receiver. Guide lugs 209 of slide 102*a* fit within the longitudinal grooves 304, 305 to facilitate reciprocal motion of the slide 102*a*. The receiver 103*a* has additional small steel molded-in rails 310 at its back for guiding the reciprocal movement of slide 102*a* and the barrel seat 14 located on the middle section has rails 1401, 1402 at both sides aligned in with rear located rails to fit and guide into the grooves in the slide 102*a* for longitudinal motion along the rails.

Figure 4:
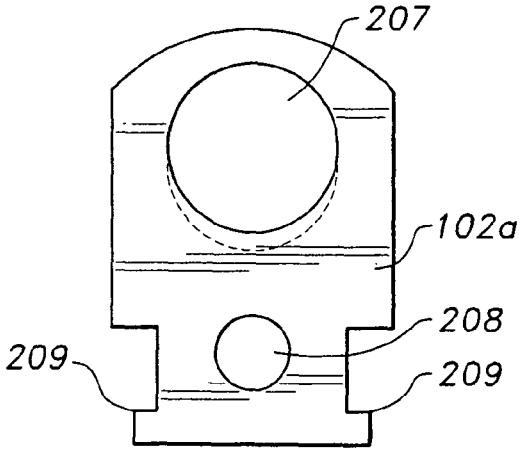
FIG. 4 is a front view of the slide of the autoloading handgun according to the present invention, showing the barrel and guide rod bores.
Figure 5:
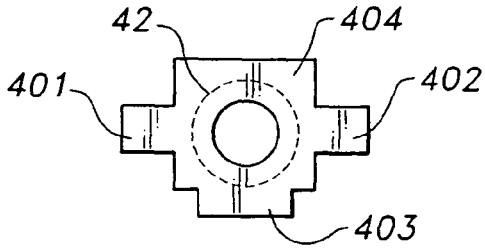
FIG. 5 is a front view of the back plate of the recoil spring guide according to the present invention.

The recoil spring 105 with its guide rod 104 is located longitudinally in an open top groove provided in front of the receiver, the guide rod 104 having a unitarily constructed back plate 42 (shown in FIG. 5) with side lugs 401,402 and a bottom lug 403 sitting into counterlocated recesses 1405, 1406 cut over the front of the barrel seat 14 and extending sidewardly therethrough outside as crossing the recesses 304, 305 provided over the receiver 103*a*. Recoil spring guide rod 104 fits through bore 208 (the bore is shown in FIG. 4) of the slide 102*a*.

The bottom lug 403 sits into a bottom lug recess formed in receiver 103*a*. An additional lug 404 is disposed at top of the back plate 42. Recoil spring guide rod 104 rests within the aforementioned recesses in mounted mode with its top lug 404 functioning to constrain guide rod 104 within barrel 101 when the rear face of the back plate 42 is propped up against the front face of front barrel cam lug 992.

The barrel seat 14 is disposed behind the recoil spring guide rod 104 as being mounted in a multi space special well 307 and it is inserted thereon via a rotational movement on the axis of a steel molded-in support bar 308 and fixed thereover by trigger axis pin 19. The barrel seat 14 is machined out from steel stock and has longitudinal rails 1401, 1402 on both sides for slide longitudinal guiding grooves 211, 212 to fit thereover for the reciprocal movement of slide 102*a*.

Cam blocks 1403,1404 are unitarily constructed from the top of barrel seat 14. Barrel cam lugs 992, 993 rest thereover as slidably movable for unlocking motion and the back face of the front lug 104 to strike against the front face of back block 1403 to be cammed down in turn. There are thick sidewalls joining with the cam blocks on top of the barrel seat 14 and they create a longitudinal groove between themselves as accepting the top portion of trigger 18 as rotatably mounted therein by trigger axis pin 19. The trigger spring 20 is also looped over the same pin with upper and shorter arm thereof resting against the underside of rear cam block 1403 (shown in FIG. 8) and its lower but longer arm resting over a hook 2202 (shown in FIG. 7) or on a lug 2201 of the trigger bar 22. The trigger bar and trigger spring connection is so arranged that via a 180 degrees turn of shorter arm on an upright axis and changing of position of longer arm of trigger spring enable: the owner to set the trigger on foremost or rearmost positions in pistol uncocked mode. Trigger spring 20 forces the trigger bar 22 upwardly in every mode and both position has own advantages. The trigger bar 22 is rotatably mounted into the trigger on its middle height over a small roll pin 21 and is exerted upwardly by trigger spring 20 and crosses the magazine well 301 through the inner top thereof at right as reaching the striker bottom ledge 1201 engagement. The trigger bar 22 is made of steel stamped sheet and carries striker safety actuator bar 2203 as an integral part as extending upwardly ending with a beveled top taking place under bottom of striker safety 110. When the trigger is taken to its rearmost position the beveled tip of safety actuator 2203 pushes the striker safety up out of its groove as clearing the forward way of striker tip to go and strike over the cap of cartridge to detonate it.

Figure 6:
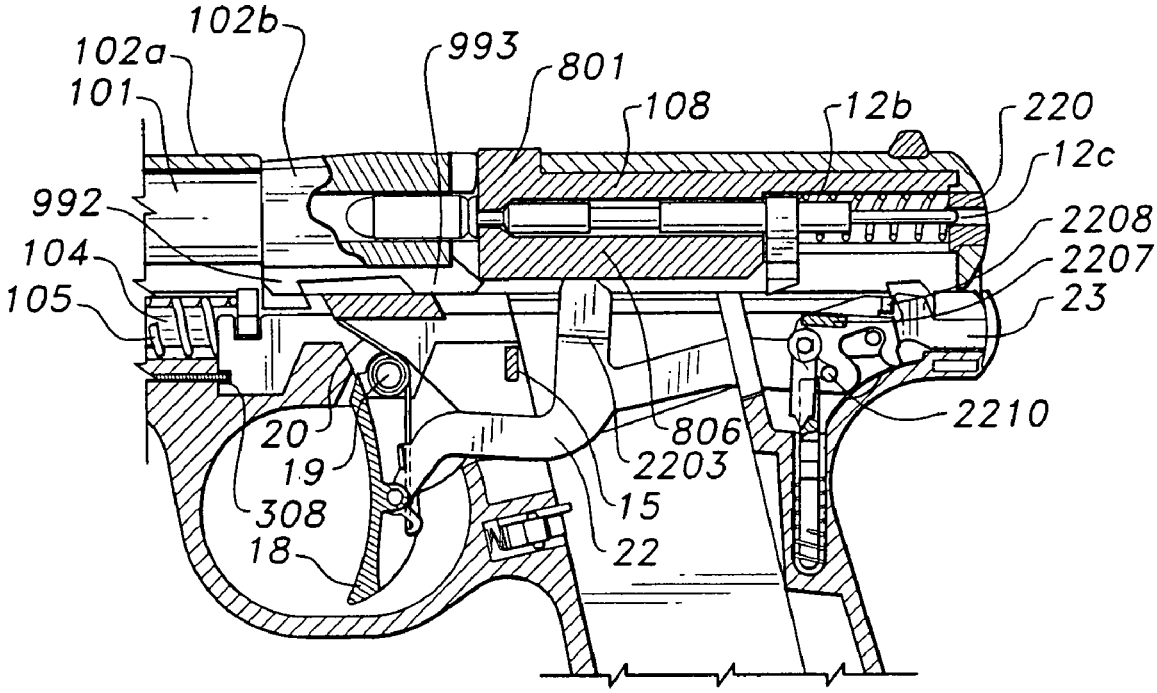
FIG. 6 is a partial side view of the autoloading handgun according to the present invention, broken away and partially in section.
Figure 9:
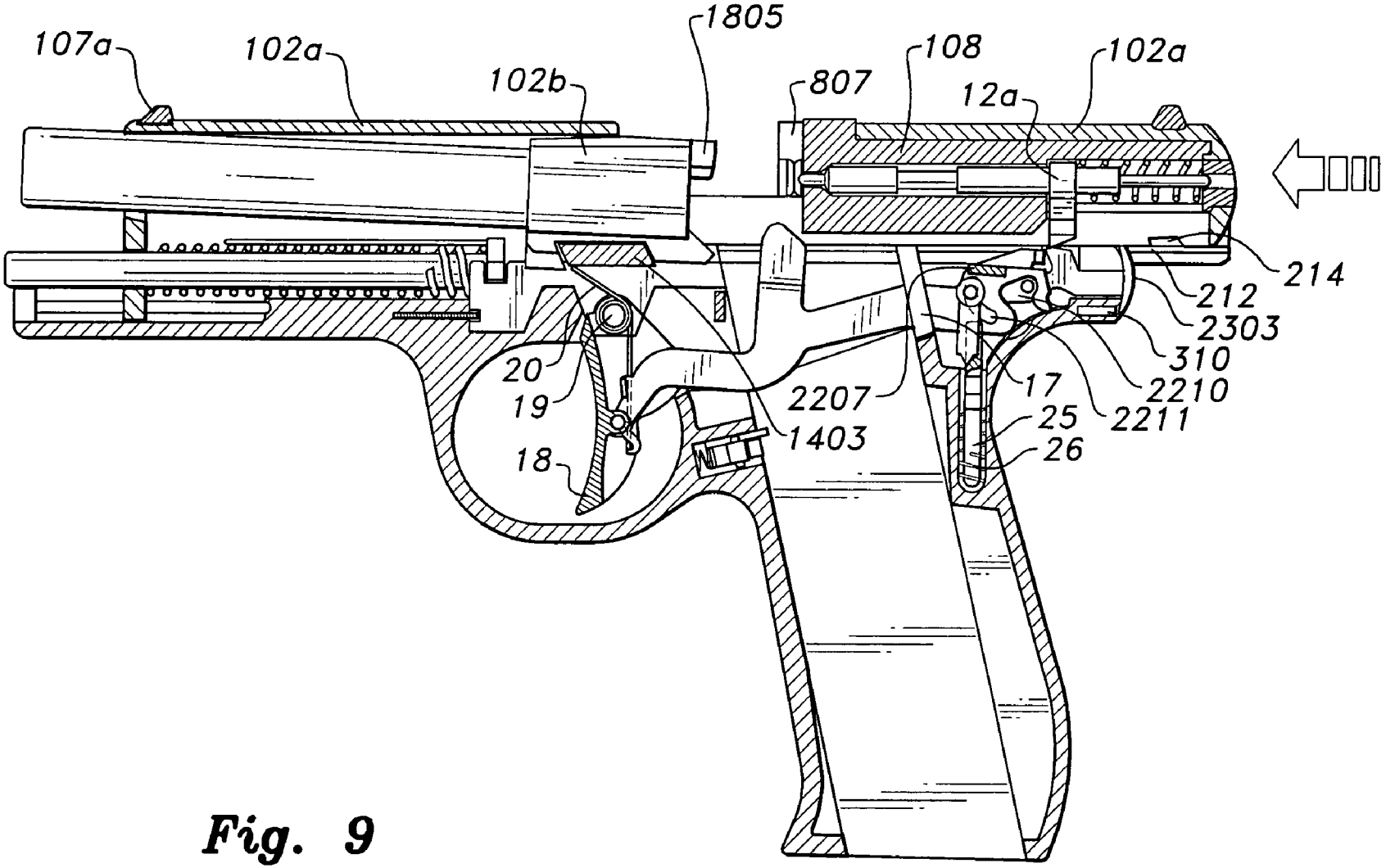
FIG. 9 is a side view of the autoloading handgun according to the present invention, broken away and partially in section, with the slide returning in a battery position.
Figure 12:
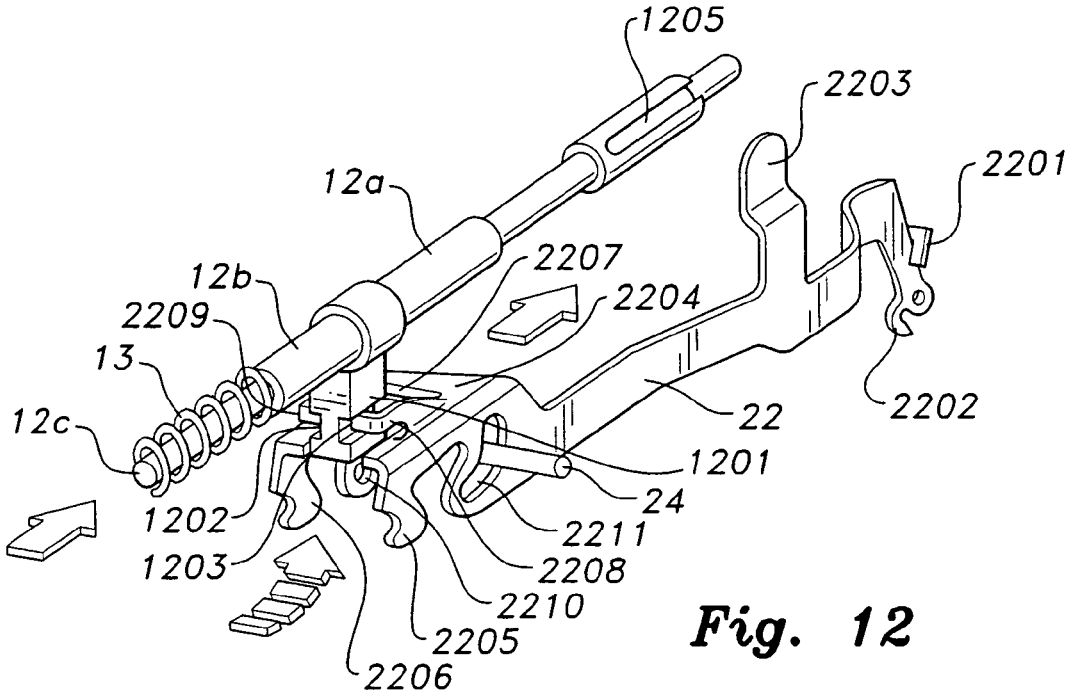
FIG. 12 is a perspective view of the striker and trigger bar of the autoloading handgun according to the present invention.

Referring to FIGS. 9 and 12, the rear section of trigger bar is comprised of two sidewalls 2205, 2206 as connected with each other by top plate 2204 carrying the upright flanges 2208, 2209 with bent in tips on their top and cocking shoulder 2207 between them in their front at bottom creating a horizontal U notch with its looking forwardly close end. A side view of handgun 10 and cam channel 2210 is shown in FIG. 6. Both sides of sidewalls of the trigger bar 22 have cam channels 2210, 2211 as a cross pin 24 tranversely passing therethrough as mounted in the receiver and transmitting the longitudinal movement of trigger bar to vertical direction by its cam effect. The trigger bar side walls slidably wrap both sides of polymer ejector carrier and this carrier contains the steel stamped ejector 17 as being molded thereon at left side and has a vertical slot between its sides to accept the safety latch 23 rotatably mounted therein over the cam pin 24 which disposes the ejector 17 within the receiver 103*a* in the same time.

Figure 19:
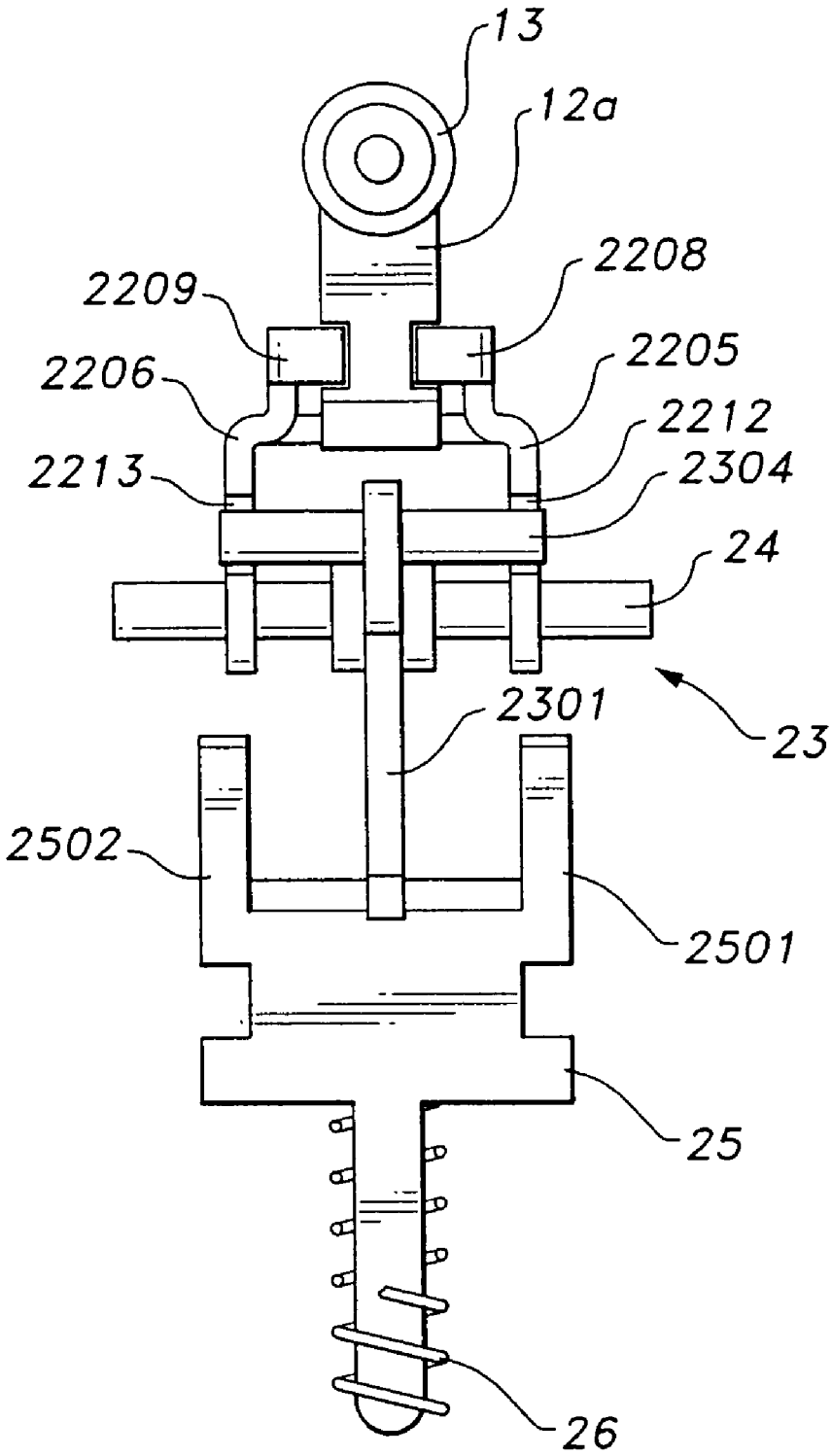
FIG. 19 is a rear view of engagement of the striker, trigger bar and safety lever of the autoloading handgun according to the present invention.

The safety latch 23 has a vertically disposed first arm 2301 extending downwardly ending with a beveled tip resting against beveled transversal top on its retaining plunger 25 which is mounted in a vertical recess in receiver 103*a* behind the magazine well 301 and looks like a vertical fork with its two upright arms 2501, 2502 being disposed under the trigger bar sidewalls 2205, 2206 (shown in FIG. 19) with its top ends at either sides and to allow contact with them when the trigger 18 is squeezed to a rearmost position thereby forcing over the trigger bar flanges 2208, 2209 to push downward riding over striker bottom leg 1201 as to go rearward.

Safety latch 23 has a rearwardly extending second arm that extends out through the receiver 103*a* and is terminated with a large thumb piece 2303. A transversal blocking pin 2304 is disposed at a midsection of the second arm to rise into notches

Figure 7:
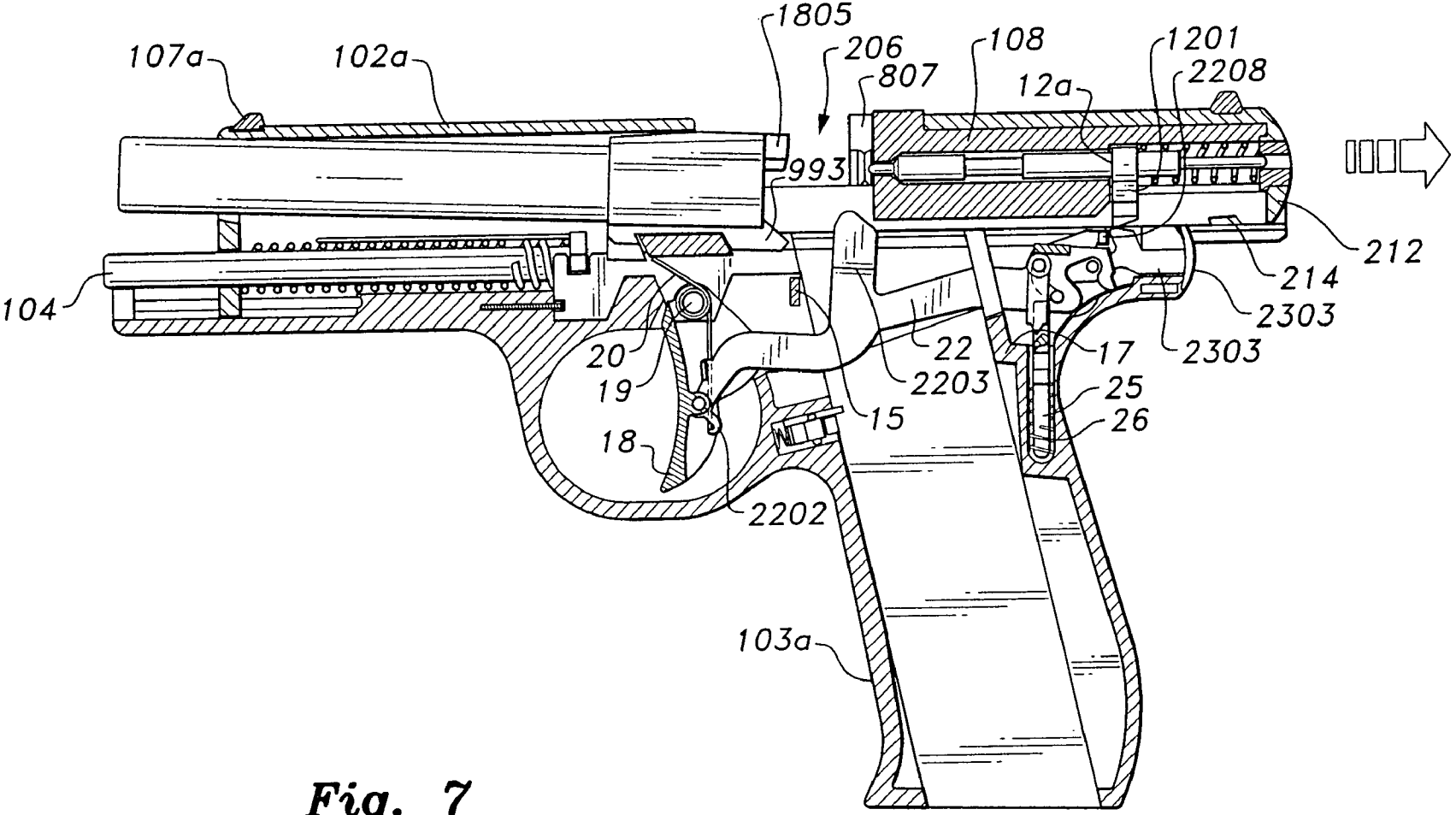
FIG. 7 is a side view of the autoloading handgun according to the present invention, showing recoil action of the slide.
Figure 18:
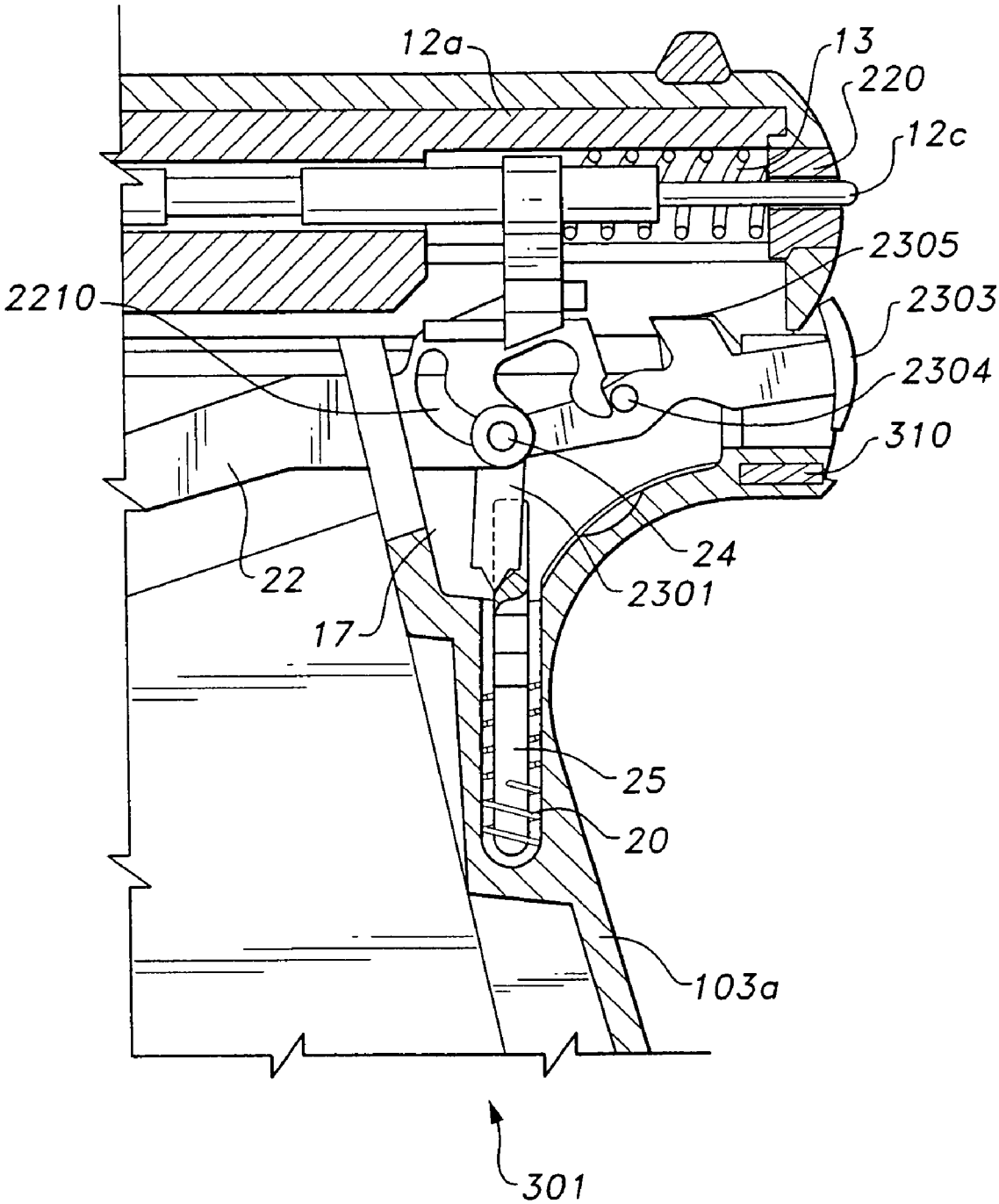
FIG. 18 is a left side view in section of the autoloading handgun according to the present invention, showing the safety latch connection in an "on" position.

2212, 2213 of trigger bar 22 when the thumb piece 2303 is flipped up to "on" position as to block the rearward movement of trigger bar 22. As shown in FIGS. 7 and 18, slide blocking lug 2305 is disposed behind the pin extending to right side and ending with an upright tip taking place under a notch 214 of the slide 102*a* to block its rearward motion when the safety is "on".

Hold-open lever 15 is mounted at left inner side of top of magazine well 301 and is laterally pivotal over unitarily constructed barrel seat pin 1407 and unitarily constructed ejector pin 1701. Pin 1407 is formed out of a left underside portion of barrel seat 14. Pin 1701 is formed by a bend extending from a forward left bottom portion of stamped steel ejector 17. The hold-open lever 15 has a sidewardly extending actuator plate 1508 that extends into the magazine well 301 for cooperative engagement with a magazine follower. A top rearmost portion of hold-open lever 15 includes a first finger piece 1501 that extends to the left and out of the receiver 103*a* through a notch 318 and another longer arm 1503 extending to the right while crossing the receiver 103*a* transversely and ending with a second finger piece 1504 extending through the right side of receiver 103*a* via a slot 319. Barrel seat collar 1408 pivotally retains arm 1503 over barrel seat pin 1407. Actuation lever tip 1509 is disposed in front of the top of the hold-open lever 15 and sits in a recess 215 when the slide 102*a* is at a rearmost position. Thus, the actuator plate 1508 can rise upward by a push from an elevating magazine follower, which pivots the hold-open lever 15 thereby stopping the slide 102*a* at its rearmost position.

The hold-open lever 15 includes a long leaf spring 16 attached at the left upper side on two opposing points, the leaf spring 16 forcing the hold-open lever 15 inwardly at upper side during normal operations of firearm 10. The direction to break the connection with slide 102*a* is sidewardly at left finger piece and vertically on right.

Slave pins secure mounting of both barrel seat 14 and ejector 17 into the receiver 103*a* as carrying their components and mounting these parts should be made after the hold-open lever 15 is first inserted into the magazine well 301 with its longer right side arm hooked out of the receiver 103*a*. Some small movement is required to engage the hold-open lever 15 over the pins at barrel seat 14 and ejector 17. Trigger axis pin 19 and cam pin 24 can be mounted after the remaining components are properly seated in the receiver 103*a*.

Trigger 18 is protected by its curled guard which is unitarily constructed from the polymer receiver 102*a* and the front section thereof is formed larger to protect the trigger from being pushed accidentally rearwardly while the handgun 10 is being placed into a tight holster.

The magazine catch 28 is mounted in front of the magazine well 301 behind the joint of trigger guard with handle section in a square sectioned hole with its coil spring 30 resting its front face and the rear of the coil spring 30 resting against a bend formed from a top portion of the latch. A vertical small roller 29 is mounted in front of coil spring 30 between top portion and lower portion of tubular catch body 28 as propped against to the middle of large V notch cut at middle of transversally mounted magazine catch button 27 and the top of tubular catch body 28 extends into magazine well 301 over the button 27 for magazine connection. An inward push over either side of button 27 will force the button 27 to ride over the roller 29 thereby pushing the catch 28 into the receiver 103*a* to free its connector tip from the magazine.

As aforementioned, the autoloading handgun 10 is of locked breech short recoil type using swinging barrel lock to stand for the powerful service cartridges and all concept is arranged the needs of such a handgun. The autoloading handgun 10 uses a standard double row magazine that has an upper section turning to one row for the sake of feeding cartridges. The magazine works in the usual manner as well known by persons having ordinary skill in the art.

The autoloading handgun 10 is loaded by inserting a loaded magazine while all components are in resting position.

Magazine catch 28 locks the cartridge store body in place within the receiver 103*a*, thus a live round is loaded therefrom to the chamber taking the slide 102*a* fully backwards and cocking the striker 12*a* by means and releasing it to go forward by exertion of compressed recoil spring 105 as stripping the top of cartridge in the magazine to drive into the chamber by means of breechblock 108.

The extractor 109 grips the cartridge case for future extracting in its extractor groove and the autoloading handgun 10 can be put into safe mode by pushing the latch 23 upwards and since the trigger 18 and backward movements of the slide 102*a* are blocked, the autoloading handgun 10 remains on fully loaded and safe mode without risk of accidental trigger actuation and reloading. The back tip 12*c* of striker 12*a* warns the owner by means of its protrusion out of the slide 102*a* that the gun is cocked. Moreover a user can also see and feel the chamber loaded mode with protruded out tip of extractor 109. The cocked mode is also duplicated by the trigger 18 being disposed in a foremost position if a user of the autoloading handgun 10 prefers to keep the trigger 18 at a rearmost position in an uncocked mode.

Taking the safety 23 to off and squeezing the trigger 18 fires the autoloading handgun 10, the projectile leaving the barrel 101 after the barrel 101 and slide 102*a* travel while being locked together a small distance backwards. Release of barrel 101 from being locked up with the slide 102*a* is by means of a vertically swinging action and backward thrust of the slide 102*a* causing the empty casing to extract itself from the chamber, the backward thrust of the slide 102*a* also cocking the striker 12*a* and ejecting a spent shell body from the autoloading handgun 10 by contacting the ejector 17 which propels the slide 102*a* to a fully rearward position, the breechblock 108 being behind the magazine thereby permitting auto reloading and by exertion of compressed recoil spring 105 the slide 102*a* goes to battery position as loading the chamber with a cartridge driven from the magazine, meanwhile striker 12*a* remains on cocked position even if the trigger 18 is continuously squeezed, because the flanges of trigger bar 22 hold the striker 12*a* at rear as ready to release forward to cocked position upon trigger pressure being released and the autoloading handgun 10 returns to a ready to fire configuration. The striker safety 110 remains on in all cocked positions and is off when the striker 12*a* is fully forward or trigger 18 is fully squeezed.

Figure 17:
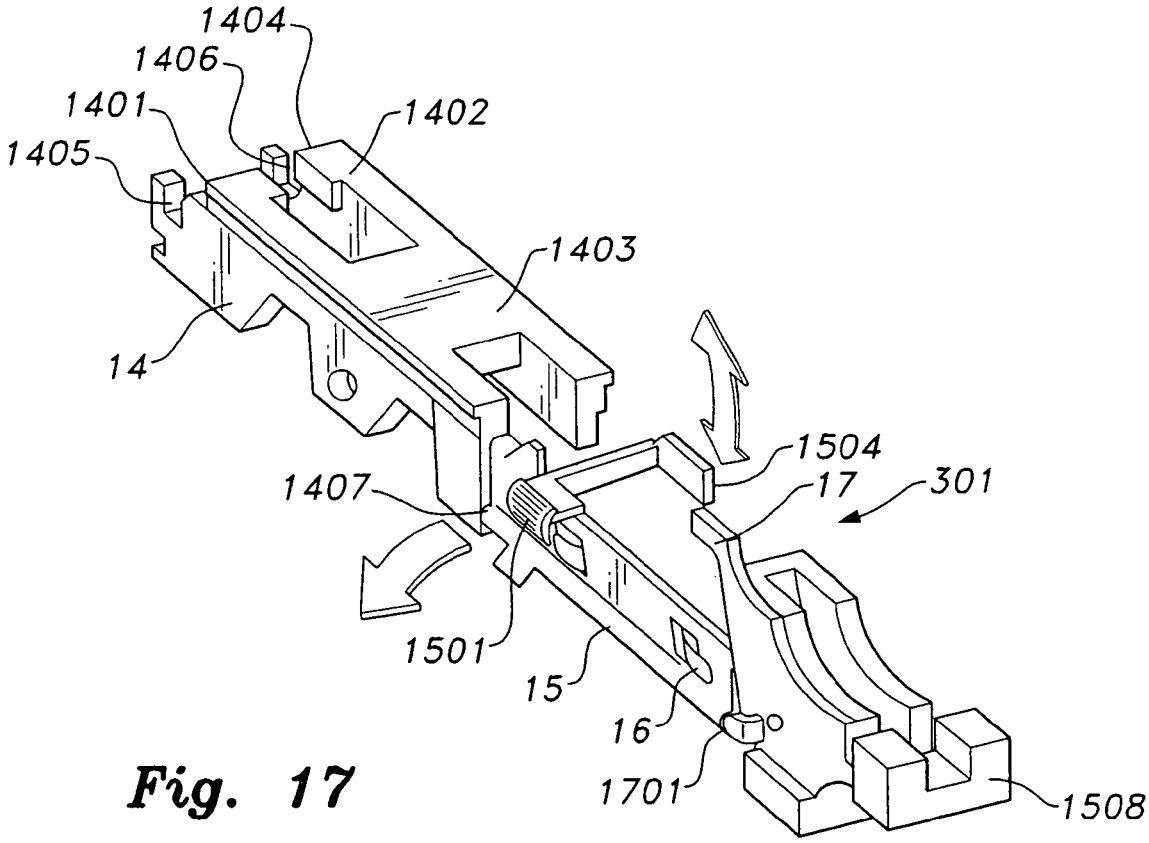
FIG. 17 is a perspective view of the hold-open lever of the autoloading handgun according to the present invention, shown connected to the cam blocks.

Moving elements for firing are the trigger 18, trigger bar 22 and striker 12*a*. As shown in FIGS. 12 and 17, flanges 2208, 2209 of trigger bar and small grooves 1202, 1203 of striker bottom leg 1201 are components of the firing mechanism. Trigger bar 22 is connected to the trigger 18 and transmits its pivotal movement to linear movement. The cam pin 24 transmits this linear longitudinal motion to vertical motion via inclined cam channels 2210, 2211. Trigger bar 22 acts longitudinally and vertically in turn to catch striker 12*a*. Striker 12*a* is cocked on its uppermost position via cocking shoulder 2207 and engages the cocking shoulder 2207 after trigger retraction on travel at back by twin flanges 2208, 2209 in a lower position and in turn permits the backward travel as being ridden over the twin flanges 2208, 2209 on its down most position and only automatically returning to a previous position at last mode by powerful exertion of spring actuated plunger 25.

The aforementioned firing action is facilitated by configuration of the cam channels 2210, 2211 as shown in FIG. 17. Cam channels 2210 and 2211 have a horizontal configuration at bottom of the channels to prevent downward inertial travel of the aforementioned firing mechanism when the gun 10 receives an impact from a foreign object, such as, e.g., when the gun falls to the floor. The release drive 2298,2298 as being inclined and longer than all at middle for intended triggered release motion lasting to free the striker 12 after carrying the same to fully cocked position, and shorter ride over drive portion 2299, 2299 being upright and on top for permission of rearward travel of striker bottom leg 1201 and automatically returning to end of release drive by exertion of safety latch plunger with its twin upright arms 2501, 2502. All of mentioned motions can be seen FIGS. 6, 7, 8, 9 and 1.

In the sequence of striker 12*a* on foremost and trigger bar 22 at rearmost, striker is going rearwards and as riding over the flanges 2208, 2209 and trigger still at squeezed, slide at rearmost and trigger squeezed and striker at just behind the flanges to drive it upwardly and forwardly to cocked positions. FIG. 12 shows the continuation of last mode with bent in tips of twin flanges 2208, 2209 traveling inside the small side grooves 1202, 1203 of striker bottom leg 1201. As seen on the related scenes, up and down motion of trigger bar is carried out by squeezing trigger finger against to compressed striker spring 13 or only by the latter in turn and since mentioned motions happen through the inclined channels 2210, 2211 being closed on top and at bottom. Additional directional force is not necessary and the system can work without or broken trigger spring 20 satisfactorily since only turn to beginning need happens at ride over drive sequences and powerful safety latch retainer spring 26 is on duty at that time.

On field service, a broken or lost trigger spring is very important for a user and the autoloading handgun is free from such a risk and this is a much desirable feature for a service handgun. Trigger bar and safety retainer plunger 25 contacts happen only at beginning of ride over drive and on its continuation by limitation of safety lever retainer arm 2301 contact tip and since it is necessary during rearward travel of slide 102*a* while slide blocking lug 2305 (shown in FIG. 18) stopping upwardly motion of safety latch 23 by means of bottom face of right slide side wall, the retaining effect of plunger 25 on latch 23 is not injured.

In autoloading pistols, a device breaking the engagement with trigger and impact element called disconnector or interceptor or any other name is necessary since the impact element should stay on cocked mode during trigger pressed and chamber to go to automatically loaded situations or in other case impact element goes to uncocked mode or automatically detonates the cartridge which all being out of intention and positive type disconnectors do not permit the mechanism to turn the trigger to retractable position until all automatically loading procedure finished by reciprocating slide and mentioned limitation, especially locked breech autoloading pistols, has another very important advantage of retaining the handgun on fully safe until all locking sequence to last or to reach "on battery" situation as being out of danger of firing the loaded cartridge while the system still on unlocked or "battery off" mode.

Since the striker 12*a* can be kept at the back to be driven to cocked mode by the flanges 2208, 2209 while the trigger being on squeezed situation, it is not necessary to use any intermediate part like disconnector in this invention but arranged combination can not provide the security of battery on mode even if human hand being not reachable such a speed to retract the trigger before the system goes fully locked position in practice. Therefore a safety device avoiding such a dangerous mode is necessary and the striker safety 110 preventing the striker 12*a* forwardly motion unless the trigger is fully retracted on slide being on foremost or battery position provides stated requirement as seen on FIG. 10 by fitting into the groove 1205 provided on front of the striker 12*a* by force of striker safety spring 11 when the striker is caught on cocked mode as being blocked to go forwardly until a few millimeters to the cartridge cap and the relating trigger bar and slide engagements permit to take the system out of connection when on fully locked situation as pushing the striker safety 110 upwardly by lug 2203 as clearing the way forwardly of striker 12*a* to impact and detonate the cartridge cap. Firing pin or striker safeties are nearly compulsory for service handguns according to new service gun regulations and providing firing pin or striker safeties precludes the necessity of devices, such as disconnectors, or the like.

A manual safety latch should block at least one of the firing elements of a weapon such as autoloading handgun 10. Such a requirement is a necessity for a weapon employed by public safety organizations since the goal is to make the device foolproof. There are numerous automatic safeties for this purpose in related art service handguns but police stations by in large cannot accept these unusable devices; therefore a manual safety as providing same ease for right and left hand users is most desirable.

The autoloading handgun 10 provides a manual safety latch 23 at rearmost portion of receiver 103*a* just below the rear-end of slide 102*a* as blocking rearward movement of the trigger bar 22 by utilizing a powerful spring 26 which transmits a force through a multi purposed plunger 25 to safety latch 23 via retaining arm 2301 which is placed vertically into the receiver at a rear portion of the magazine well 301.

Safety latch thumb piece 2303 as taken upwardly with a sound click blocks the rearward movement of trigger bar 22 via its locking bar 2304 as placing into provided recesses 2212, 2213 on the pistol cocked mode and also blocks the rearward movement of slide 102*a* by another sidebar 2305 as going into a provided recess 214 cut underside near the end of right side wall of slide.

Figure 15:
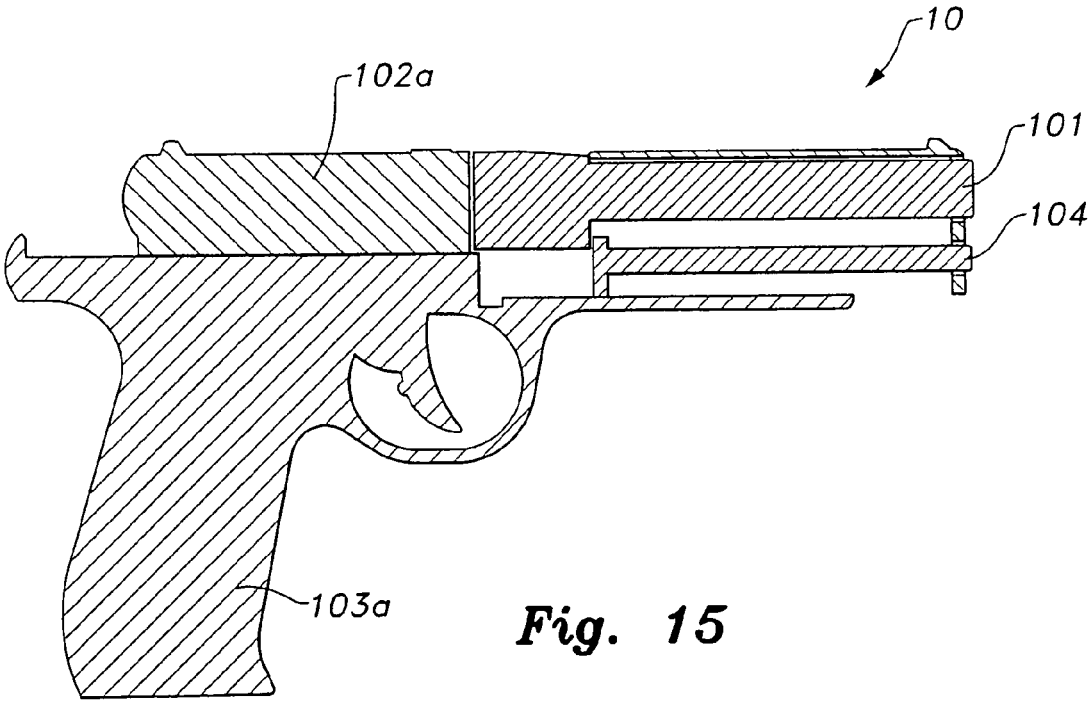
FIG. 15 is a side view in section of the autoloading handgun according to the present invention, shown in a second dismounting position.

Moreover, the safety latch can be placed "on" in an uncocked mode but happens to cocked mode automatically by exertion of trigger spring 20 if the trigger at foremost mode is chosen for normal times and again turns into cocked mode in other mode preference should a slight push be applied to the trigger. FIG. 15 shows related parts configuration of the autoloading handgun in the cocked mode.

The retaining effect of safety latch plunger is powerful enough against to accidental charges and the thumb piece is large enough to reach and apply on nearly every conditions and its location enables right and left hand users to manipulate it on the same easiness. This is also another very important feature for a service handgun.

Hold-open levers catching the part which closing the rear of breech stop the gun open after the last cartridge brought through the weapon either by firing or by hand or drawing the same component backwardly on an empty magazine or without a magazine but drawing the same and manipulating the device are useful for service guns as warning the owner that the gun is emptied and giving speed and ease of reloading or for safety purposes to inspect the chamber situation or cleaning purposes. Existing service autoloading pistols use vertically acting levers cooperating with magazine follower for this purpose and they offer additional levers for left hand users if required means more parts to care about both using and repair.

Figure 13:
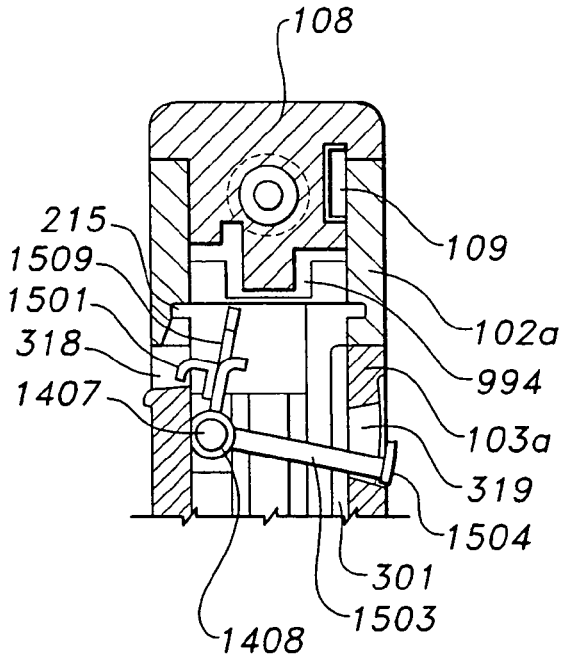
FIG. 13 is a partial section view of the autoloading handgun, according to the present invention, showing the hold-open lever.
Figure 16:
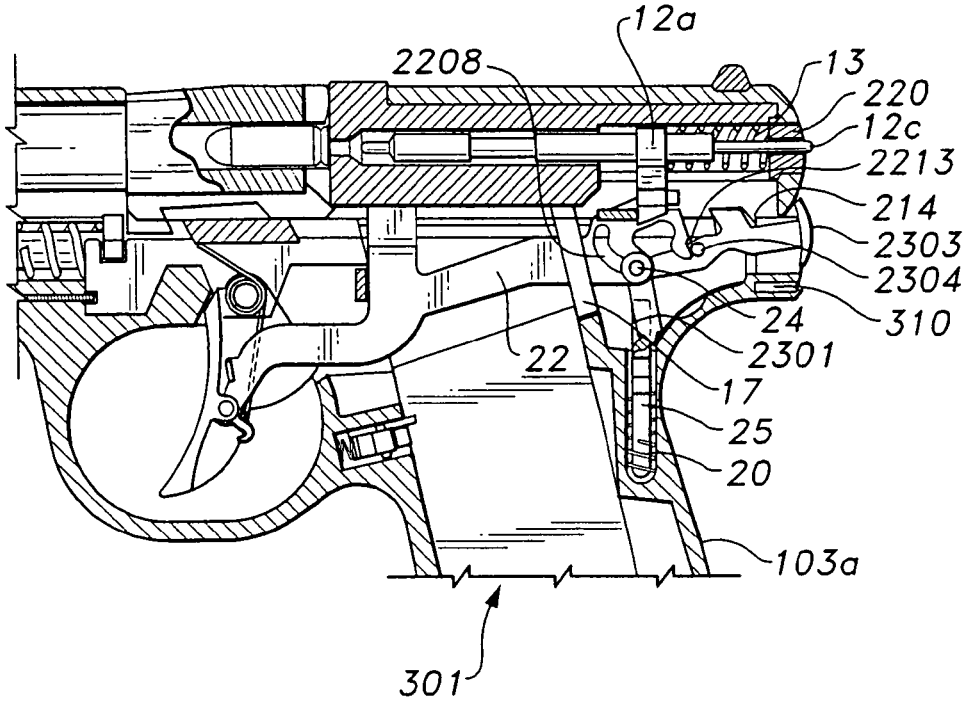
FIG. 16 is a partial left section view of the autoloading handgun according to the present invention, broken away and partially in section, showing the safety latch connection in an "on" position.

The autoloading handgun uses a hold-open lever 15 for this purpose pivoting sideward as contrary to typical vertical movement in related art handguns. The construction and placement of mentioned device can be seen on FIGS. 13 and 16 and as usual, the actuator of this device is same with other samples as magazine follower.

The hold-open lever 15 is located at inside top portion of magazine well 301 at the left and is sidewardly rotatable over the pins 1407 and 1701. The pins 1407 and 1701 are both of unitary construction from the body of barrel seat 14 and the body of ejector 17. The hold-open lever 15 is comprised of a single pivoting member having a spring 16 fixed thereover for either right or left hand users. The hold-open lever 15 functions via interoperability with a magazine follower of firearm 10. A small flange at left side of the magazine follower of firearm 10 imparts an upward push during elevation to engage the actuator plate 1508 of hold-open lever 15 which causes the lever to rotate to left side with a finger piece 1501 protruding outside through a provided recess 318 at top of handle section of the receiver 103*a* at left side and with another arm 1503 crossing the receiver body to the right side and emerging outside through a slot 319 provided at right side of handle section of receiver 103*a* as another finger piece 1504 and with an upright lug 1509 locating into a recess 215 cut left underside of side wall of slide 102*a* coming in vertical line with the slide 102*a* when the slide 102*a* is on rearmost situation and stopping its forwardly motion thereat and pressing the leaf spring 16 located on the lever body to left side against the inner face of magazine well 301.

Simply pressing the left finger piece 1501 inwardly or pushing the right finger piece 1504 downwards frees the top lug 1509 out of engagement with recess 215 and permits the slide 102*a* to go forward by exertion of compressed recoil spring 105. A small backward push to slide 102*a* can do the same instead of using the levers without a magazine or with a loaded round in the pistol 10.

For all types of handguns joining the main parts together and taking apart of them as major groups is important and necessary for maintenance and repair purposes. The process is called "field stripping" and is more important for service handguns since even the dumbest person using it can find himself in repair or maintenance situations. Therefore, handgun designed for this purpose should have constructed with minimum of parts possible and its main parts should be dismantled in major groups in minimum of number as avoiding loosing in service conditions. Especially tiny parts are subject to being lost in the field and they have another disadvantage of the potential for incorrect reassembly.

Field stripping of autoloading pistols entails separating the firer loader component from the carrier counterpart carrying all other pieces thereon. Magazine is not considered as a component in this process since its attachment or removal occurs frequently without disassembly of the other gun components. Therefore excepting the magazine, it would be desirable to limit the number of components to disassemble during the field stripping process.

The autoloading handgun uses a swinging barrel for locked breech, therefore the recoil spring 105 is preferably separated from the other gun components since a longitudinally and vertically acting barrel together with a slide must be forced to return to a rest position minimum of one return spring for this purpose and a recoil spring 105 coiled around the barrel 101 as being held thereover can not return the complete system to rest position because joint travel of both components over the carrier receiver requires another return spring to turn to rest position as summing the amount of minimum major group number as four as counting the recoil spring 105 and its guide rod 104 one since the spring 105 can be held over the rod 104 simply the rearmost coil thereof being wrapped around a retaining groove thereat.

Therefore, an autoloading pistol of swinging barrel locked breech short recoil type may be broken down into four major groups excluding the magazine, as slide, barrel, recoil spring and the receiver, and thus, the autoloading handgun is configured to achieve the aforementioned goals.

Figure 14:
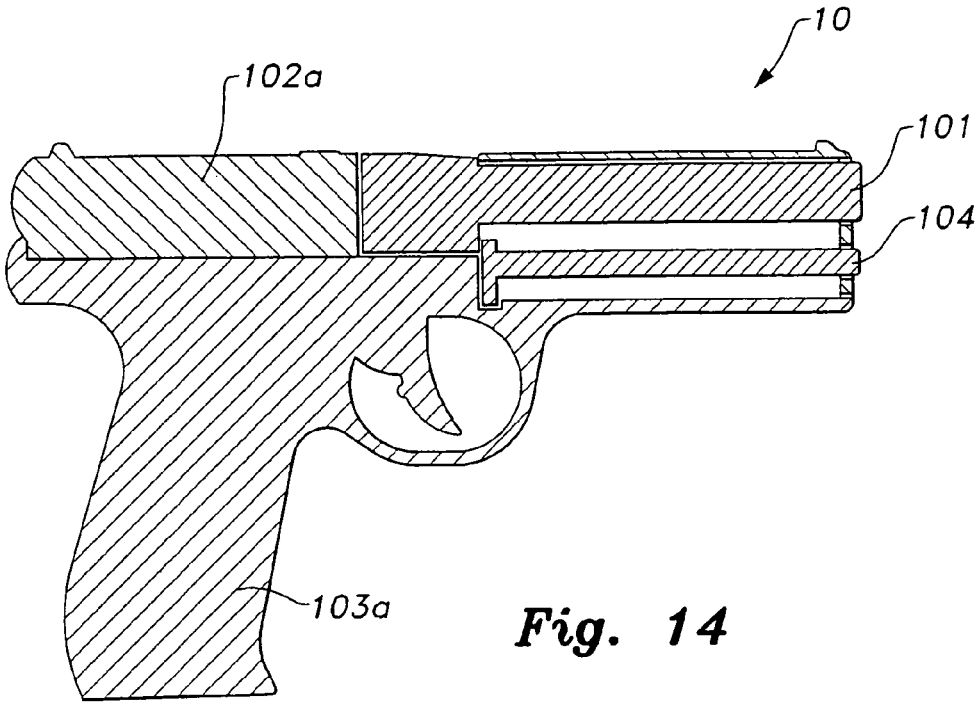
FIG. 14 is a side view in section view of the autoloading handgun according to the present invention, shown in a first dismounting position.

Generally there is a certain component by means of which the field stripping process begins. Typically such a component has been a small piece, like a pin or lever in usual known types, that is subject to being lost. To eliminate the usage of a small field stripping component, in the autoloading handgun 10, the recoil spring guide rod 104 is used as the key component to initiate the stripping process as can be seen in FIG. 14. The main components, barrel 101, slide 102*a*, receiver 103*a* and recoil spring rod 104 are joined together at the back of recoil spring rod 104 located into a recess in the receiver 103*a*. As shown in FIGS. 14-15, separation of the barrel 101 and other aforementioned components is achieved by removing the back of recoil spring rod 104 from its recess in receiver 103*a* which clears the way for removal of barrel 101 and slide 102*a*.

The aforementioned aim is carried out with a back plate 42 having side lugs 401,402 being unitarily constructed therefrom and being in contact with underside of sidewalls of slide 12*a* in all times and giving way out for barrel 101 and slide 102*a* only when mentioned sidelugs risen upwardly into the notches 214, 215 solely on an intended point where slide 102*a* taken a few millimeters behind the side lugs seats 304, 305 on the receiver 103*a*. These seats are the extensions of the seats 1405, 1406 cut on top in front of barrel seat 14 and give enough strength for arrestment of barrel 101 over the receiver 103*a* as fortified by another recess for bottom lug 404 as retaining the major groups on the receiver all the times except during field stripping. A user holds the trigger 18 in a retracted position while removing the barrel 101 and slide 102*a* during fieldstripping if trigger on forward mode on normal times has been chosen.

Figure 21:
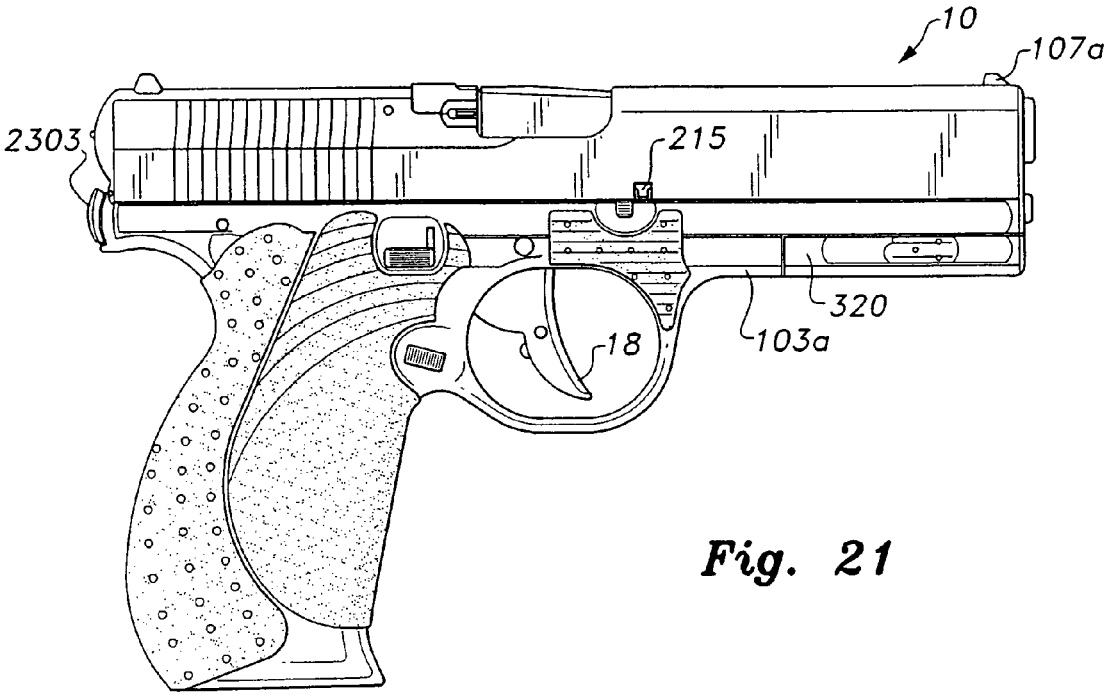
FIG. 21 is a right side view of the autoloading handgun according to the present invention, showing the slidable cover.
Figure 22:
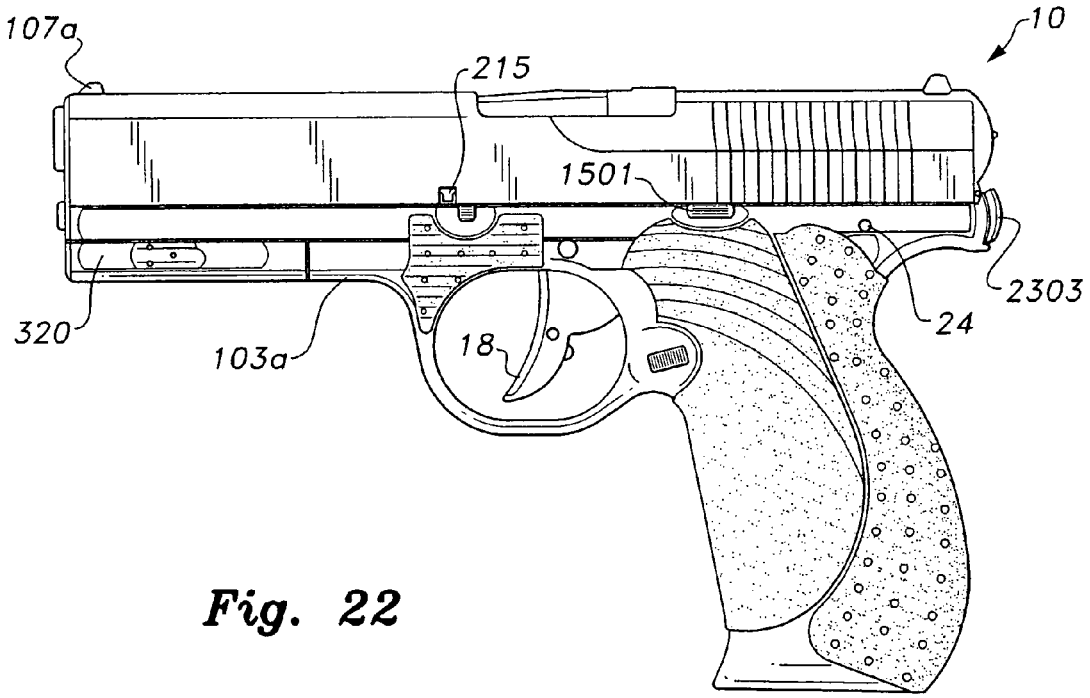
FIG. 22 is a left side view of the autoloading handgun according to the present invention, showing the slidable cover.
Figure 23:
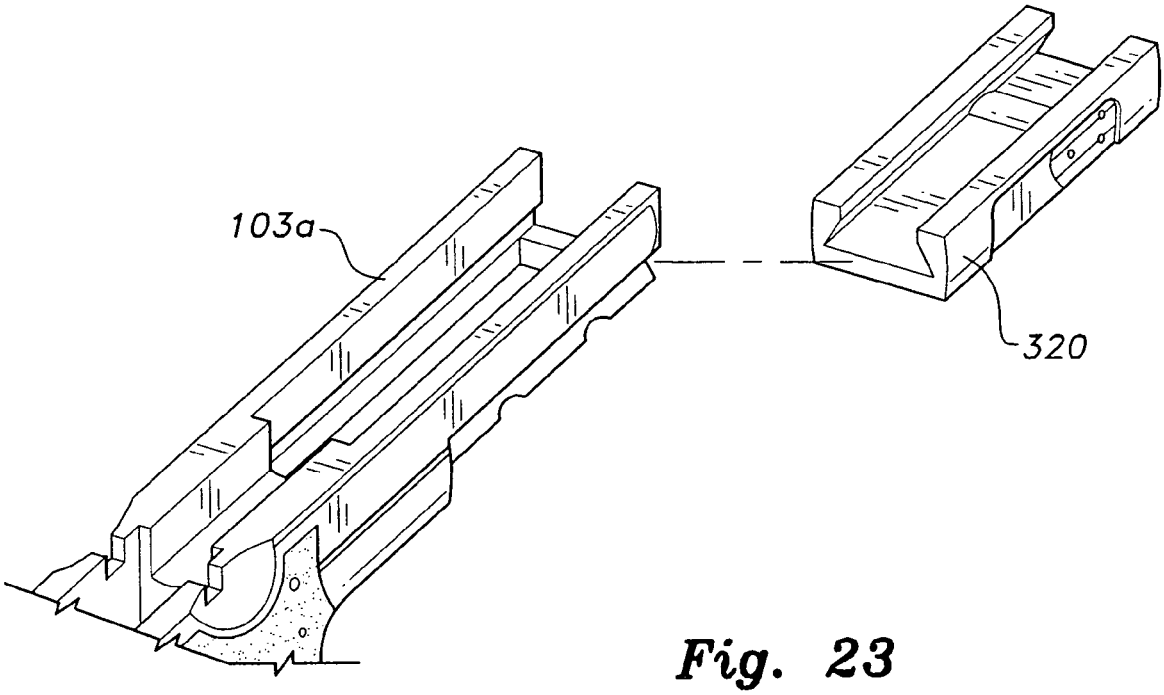
FIG. 23 is an exploded perspective view of the slidable cover fitting over the receiver of the autoloading handgun according to the present invention.

In the embodiment of the autoloading handgun shown in FIGS. 21-23, a slidable, accessory rail 320 is provided at the front of receiver 103*a*. As most clearly shown in FIG. 23, the slidable cover 320 has chamfered sidewalls that slide into a bottom portion of the receiver 103*a*. The cover 320 is to be inserted onto the receiver 103*a* when no accessory is being used, the cover 320 thereby preventing dirt from accumulating into dovetailed grooves of receiver 103*a*.

It is to be understood that the present invention is not limited to the embodiment described above, but encompasses any and all embodiments within the scope of the following claims.

I claim:

1. An autoloading handgun, comprising:

an elongated receiver, the receiver having a handgrip portion defining a cavity therein, the receiver having a forward end, a rearward end, and a longitudinal axis;

a magazine removably disposed in the handgrip portion;

a barrel supported on the receiver, the barrel having a bore defined on an axis of the barrel;

a firing assembly having a trigger, trigger bar and striker arranged in operable relation, the striker being coaxially aligned with the barrel; and a slide slidably engaged with the barrel and receiver when the handgun is fired, the slide having a forward portion and a rearward portion, the rearward portion including a change in profile; and a manual safety latch extending from the rearward end of the receiver and including an axis substantially parallel to the longitudinal axis, the manual safety latch including a feature engageable with the change in profile on the slide to place the handgun in a safe, non-operational mode and to alternately disengage the feature from the change in profile to place the handgun in a non-safe, operational mode, wherein the trigger bar includes a feature engageable with the safety latch simultaneously with the engagement of the safety latch and slide.

2. The autoloading handgun according to claim 1, wherein the receiver has a plurality of recesses defined therein disposed under the slide, the autoloading handgun further comprising a recoil rod having a back plate, the back plate having side lugs engaging the receiver recesses under a bottom portion of the slide, the slide having indentions accepting the lugs, the lugs removably retaining the barrel, slide and receiver in an operable configuration.

3. The autoloading handgun according to claim 1, further comprising a striker spring disposed over the striker, the striker spring providing sufficient potential energy to the striker so that the striker is propelled against a round of ammunition to fire the round when the trigger is squeezed.

4. The autoloading handgun according to claim 1, further comprising a lever pivotally mounted in the receiver, the lever having a portion blocking the slide in an open position when the magazine is emptied.

5. The autoloading handgun according to claim 1, further comprising a cover slidably engageable with a bottom portion of the receiver, the cover preventing dirt from accumulating in the receiver.

6. The autoloading handgun according to claim 1, further comprising a recoil rod having a back plate, the back plate having side lugs, the back plate sidelugs engaging recesses defined in the receiver under a bottom portion of the slide, the slide having indentions accepting the lugs, the lugs removably retaining the barrel, the slide and the receiver in an operable configuration.

* * * * *